US010612481B2

(12) United States Patent
Sharp et al.

(10) Patent No.: US 10,612,481 B2
(45) Date of Patent: Apr. 7, 2020

(54) ACCELERATION BASED HIGH IDLE

(71) Applicant: Caterpillar Inc., Deerfield, IL (US)

(72) Inventors: Jeremy T. Sharp, St. Charles, IL (US); Daniel Tisza, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 124 days.

(21) Appl. No.: 15/988,603

(22) Filed: May 24, 2018

(65) Prior Publication Data

US 2019/0360418 A1 Nov. 28, 2019

(51) Int. Cl.
*F02D 41/08* (2006.01)
*F02D 41/04* (2006.01)

(52) U.S. Cl.
CPC ..... *F02D 41/083* (2013.01); *F02D 41/045* (2013.01); *F02D 2200/1002* (2013.01)

(58) Field of Classification Search
CPC ..... F02D 41/083; F02D 41/045; F02D 2200/1002
See application file for complete search history.

(56) References Cited

U.S. PATENT DOCUMENTS

| | | | | |
|---|---|---|---|---|
| 6,019,702 | A | 2/2000 | Ehrenhardt et al. | |
| 7,353,105 | B2 | 4/2008 | Mino et al. | |
| 9,423,802 | B2 | 8/2016 | Minase et al. | |
| 9,488,119 | B2 | 11/2016 | Frelich | |
| 2005/0020406 | A1* | 1/2005 | Aldrich | F02D 41/0215 477/111 |
| 2017/0088138 | A1 | 3/2017 | Goli et al. | |

* cited by examiner

*Primary Examiner* — Jacob M Amick
*Assistant Examiner* — Charles Brauch
(74) *Attorney, Agent, or Firm* — Schwegman, Lundberg & Woessner

(57) ABSTRACT

A work machine includes an engine configured to generate power to operate the machine and a controller. The controller is configured to determine an actual load on the engine, determine a machine acceleration, and select an engine high idle speed based upon the actual engine load and the machine acceleration.

20 Claims, 4 Drawing Sheets

ACCELERATION BASED HIGH IDLE

BACKGROUND

Work machines can include controls that are configured to monitor and, in some cases, automatically control various aspects of machine operation. As an example, some work machines include controls that automatically modulate engine high idle speed based on one or more parameters. At times of reduced machine workload, less than full engine power may be sufficient for effective machine performance. Such periods of reduced workload present opportunities for increasing fuel efficiency as well as for reducing machine noise.

Some work machine controls supplement a so-called standard power high idle mode with an economy high idle mode for such purpose. Some such economy modes offer a relatively low engine high idle speed during periods of reduced workload demand, while automatically switching back to the power engine high idle mode and speed whenever the machine may encounter higher workloads.

The power engine high idle mode generally produces a relatively high high idle speed. The power mode has an advantage of being more immediately responsive to abrupt changes in workload demand. For example, under the power mode, there is less risk of the engine becoming bogged down upon encounters of transient and/or spontaneous increases in workload demand.

SUMMARY

In an example, a work machine includes an engine configured to generate power to operate the machine and a controller. The controller is configured to determine an actual load on the engine, determine a machine acceleration, and select an engine high idle speed based upon the actual engine load and the machine acceleration.

In an example, a method of operating a work machine includes determining, by a controller of the machine, an actual load on an engine of the machine, determining, by the controller, an acceleration of the machine, and setting, by the controller, the high idle speed of the engine based on the actual engine load and the machine acceleration.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present disclosure recognizes, among other things, that additional factors can be used to manage and improve the balance between performance and fuel economy in work machines. For example, there are situations in which whether or not and at what rate a work machine is accelerating can bear on machine performance and engine fuel economy.

Some work machines include controls for selecting between a low high idle speed and a high high idle speed based upon a load being applied to the engine of the machine. The engine load is the power required to propel the machine, but may also include power drawn from the engine for other functions, including to drive one or more implements, for example, off of a power-take-off (PTO) mechanism. Multiple high idle speeds and selection therebetween may be employed in an attempt to provide increasing levels of fuel efficiency without losing an unacceptable amount of performance.

In addition to selecting between a low and high high idle speed, some work machines may also use a variable high idle speed, which varies depending upon, for example, engine load. For example, some work machines include controls that select between a low high idle speed and a high high idle speed based upon engine load.

As used in this disclosure in relation to engine high idle speeds, the terms "low" and "high" are relative terms indicative of the relative magnitude of engine speed (at high idle). As used herein, "low" high idle speed(s) at least includes values, the magnitude of which are less than a corresponding "high" high idle speed. Similarly, "high" high idle speed(s) at least includes values, the magnitude of which are more than a corresponding "low" high idle speed. For clarity and conciseness, situations involving selection between multiple high idle speeds or multiple low idle speeds may be described as, for example, a first high idle speed and a second high idle speed instead of a low high idle speed and a high high idle speed.

In some situations, selecting a variable high idle speed based upon engine load may be improved (in terms of, for example, improved or maintained machine performance and increased fuel economy) by pegging idle speed control to additional parameters. In examples according to this disclosure, engine high idle speed is controlled based upon engine load and acceleration, because acceleration can significantly impact fuel economy, while increased power availability (by switching to higher engine high idle) during some acceleration events may not increase or only marginally increase machine performance.

Figure 1:
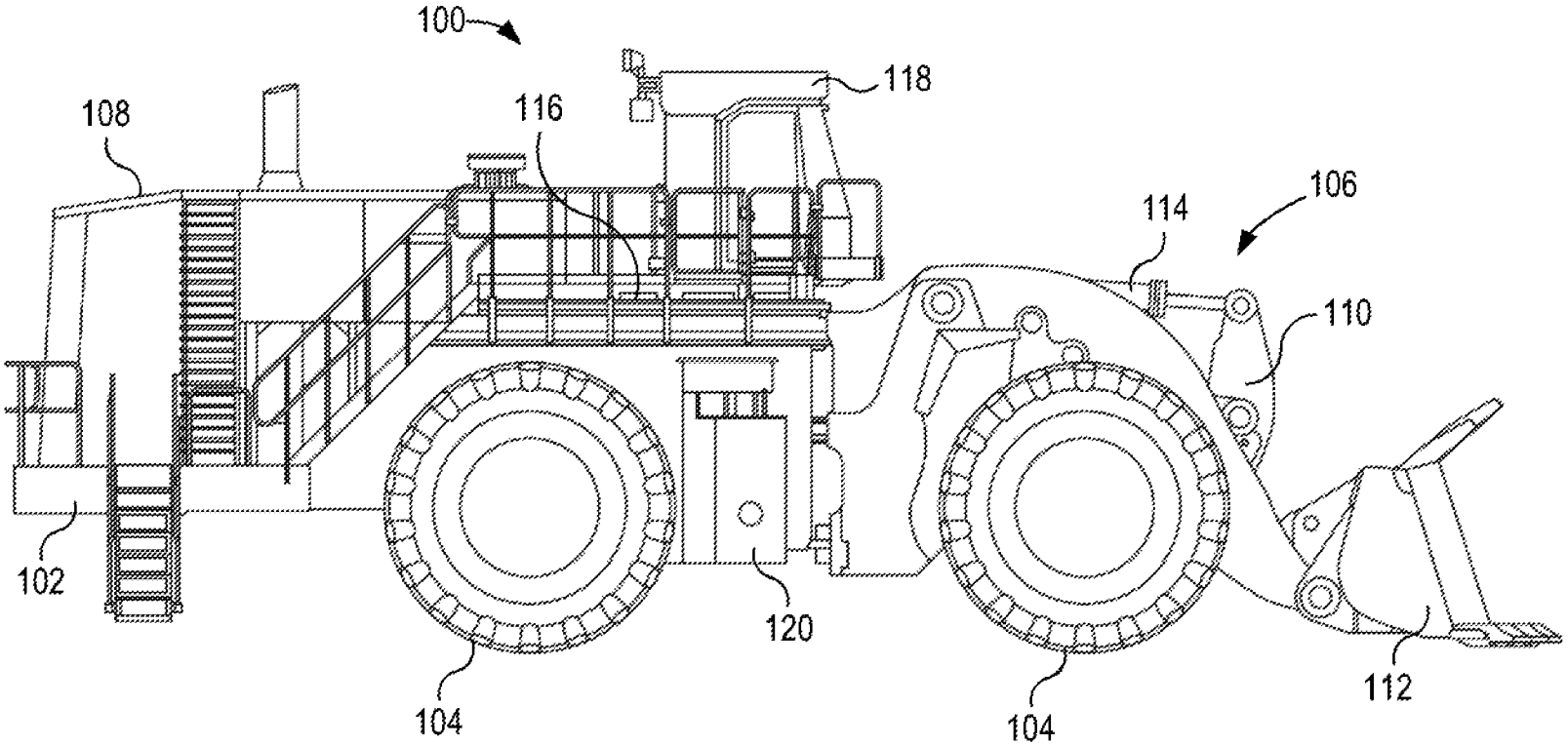
FIG. 1 depicts an example work machine in accordance with this disclosure.

FIG. 1 depicts an example machine 100 in accordance with this disclosure. In FIG. 1, machine 100 includes frame 102, wheels 104, implement 106, and a high idle speed control (ISC) implemented in one or more on-board electronic devices like, for example, an electronic control unit or ECU. Example machine 100 is a wheel loader. In other examples, however, the machine may be other types of machines related to various industries, including, as examples, construction, agriculture, forestry, transportation, material handling, waste management, and so on. Accordingly, although a number of examples are described with reference to a wheel loader machine, examples according to this disclosure are also applicable to other types of machines including graders, scrapers, dozers, excavators, compactors, material haulers like dump trucks, along with other example machine types.

Machine 100 includes frame 102 mounted on four wheels 104, although, in other examples, the machine could have more or fewer than four wheels. Frame 102 is configured to support and/or mount one or more components of machine 100. For example, machine 100 includes enclosure 108 coupled to frame 102. Enclosure 108 can house, among other components, an engine and/or other drive system to propel the machine over various terrain via wheels 106. The engine can include various power generation platforms, including, for example, an internal combustion engine, whether gasoline or diesel.

Machine 100 includes implement 106 coupled to the frame 102 through linkage assembly 110, which is configured to be actuated to articulate bucket 112 of implement 110. Bucket 112 of implement 106 may be configured to transfer material such as, soil or debris, from one location to another. Linkage assembly 110 can include one or more cylinders 114 configured to be actuated hydraulically or pneumatically, for example, to articulate bucket 112. For example, linkage assembly 110 can be actuated by cylinders 114 to raise and lower and/or rotate bucket 112 relative to frame 102 of machine 100.

Platform 116 is coupled to frame 102 and provides access to various locations on machine 100 for operational and/or maintenance purposes. Machine 100 also includes an operator cabin 118, which can be open or enclosed and may be accessed via platform 114. Operator cabin 118 may include one or more control devices (not shown) such as, a joystick, a steering wheel, pedals, levers, buttons, switches, among other examples. The control devices are configured to enable the operator to control machine 100 and/or the implement 106. Operator cabin 118 may also include an operator interface such as, a display device, a sound source, a light source, and various combinations thereof.

Machine 100 can include a tank compartment connected to frame 102 and including fuel tank 120. Fuel tank 120 is fluidly coupled to the engine. Tank 120 is configured to store a fuel therein and serve as a source for supply of the fuel to the engine of machine 100. Machine 100 may also include other tanks, for example, to store and supply hydraulic fluid to implement 106 or other components of machine 100.

Machine 100 can be used in a variety of industrial, construction, commercial or other applications. Machine 100 can be operated by an operator in operator cabin 118. The operator can, for example, drive machine 100 to and from various locations on a work site and can also pick up and deposit loads of material using bucket 112 of implement 106. As an example, machine 100 can be used to excavate a portion of a work site by actuating cylinders 114 to articulate bucket 112 via linkage 100 to dig into and remove dirt, rock, sand, etc. from a portion of the work site and deposit this load in another location.

In examples according to this disclosure, the ISC of machine 100 is configured to automatically switch between a first high idle speed and a second high idle speed for the engine based upon the load on the engine and the acceleration of the machine. For example, the ISC can: determine an actual load on the engine of machine 100; determine an actual acceleration of the machine; and automatically set the high idle speed of the engine based upon the engine load and the acceleration. In one example, the ISC determines that the engine load is equal to or greater than a load threshold and that the acceleration is equal to or less than a threshold and, based thereon, automatically sets the high idle speed of the engine to the second high idle speed. In this example, the second high idle speed is greater than the first high idle speed.

Figure 2:
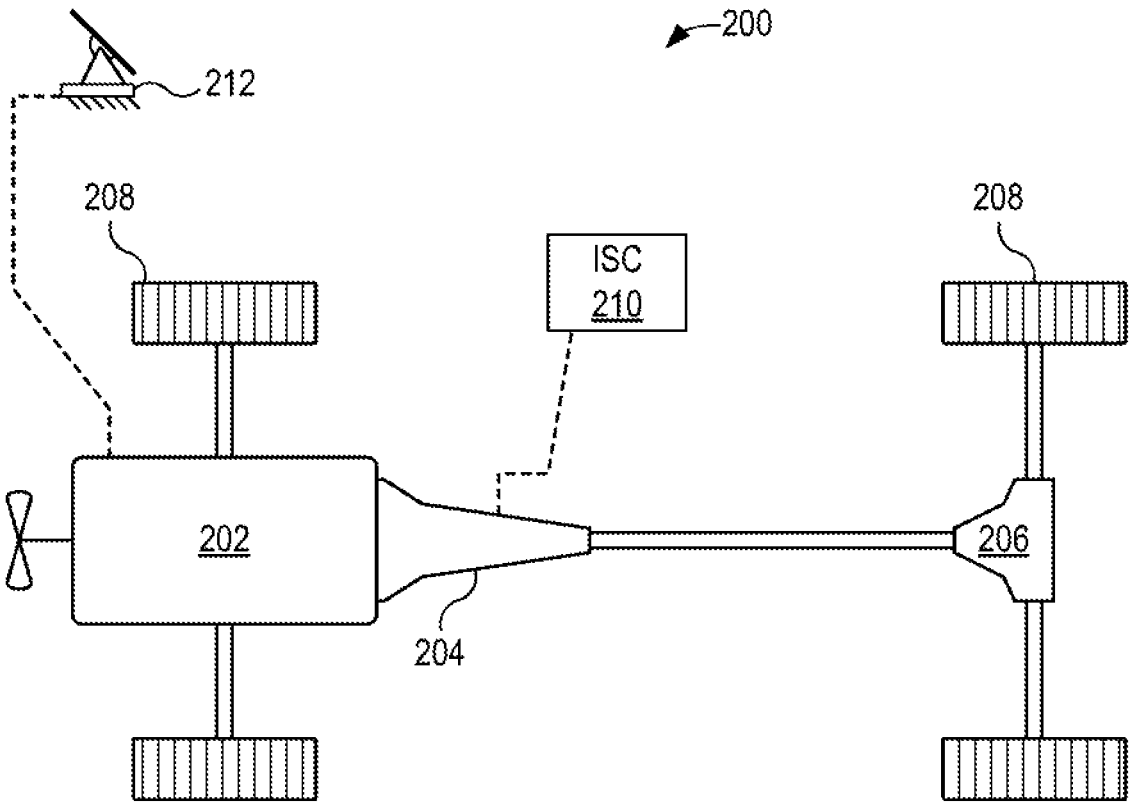
FIG. 2 depicts another example work machine in accordance with this disclosure.

FIG. 2 is a schematic depicting another example machine 200 in accordance with this disclosure. Machine 200 includes engine 202, transmission 204, differential 206, wheels 208, ISC 210, and throttle control 212. Engine 202 is operatively coupled to transmission 204, which transmission can be a mechanical or hydraulic automatic transmission, as examples. Additionally, transmission 204 can be a continuously variable transmission (CVT), including, for example, a hydraulic CVT. Transmission 204 is operatively coupled to differential 206, which transmits power from the transmission to wheels 208 to propel machine 200. Engine power and speed can be controlled by an operator using throttle control 212. Throttle control 212 is depicted in the example of FIG. 2 as a foot peddle, but, in other examples, can be another type of input control device, including a hand lever or dial, as examples.

Although not shown in FIG. 2, machine 200 can include one or more implements operatively coupled to the machine and configured to execute various functions, including excavation, grading, and compacting, as examples. Additionally, such implements may be driven by/draw power from (directly or indirectly) engine 202 and the actual load on the engine may therefore reflect loads produced by the implement(s).

ISC 210 can be implemented in a variety of different configurations, as will be explained in more detail with reference to FIG. 3. However, in general, ISC 210 is communicatively and, as necessary, otherwise connected to components of work machine 100 and is disposed somewhere on or in the machine. ISC 210 may be, for example, connected to an operator input control, which can be used by an operator to manually set engine speed, for example, between a low idle and a high idle speed.

ISC 210 can include software, hardware, and combinations of hardware and software configured to execute a number of functions related to automatically (e.g., without operator input) different high idle speeds of engine 202 of machine 200. ISC 210 can be an analog, digital, or combination analog and digital controller including a number of components. As examples, ISC 210 can include integrated circuit boards or ICB(s), printed circuit boards PCB(s), processor(s), data storage devices, switches, relays, etcetera. Examples of processors can include any one or more of a microprocessor, a controller, a digital signal processor (DSP), an application specific integrated circuit (ASIC), a field-programmable gate array (FPGA), or equivalent discrete or integrated logic circuitry.

ISC 210 may include storage media to store and/or retrieve data or other information, for example, signals from sensors or other electronic devices. Storage devices, in some examples, are described as a computer-readable storage medium. In some examples, storage devices include a temporary memory, meaning that a principal purpose of one or more storage devices is not long-term storage. Storage devices are, in some examples, described as a volatile memory, meaning that storage devices do not maintain stored contents when the computer is turned off. Examples of volatile memories include random access memories (RAM), dynamic random access memories (DRAM), static random access memories (SRAM), and other forms of volatile memories known in the art. The data storage devices can be used to store program instructions for execution by processor(s) of ISC 210. The storage devices, for example, are used by software, applications, algorithms, as examples, running on and/or executed by ISC 210. The storage devices can include short-term and/or long-term memory, and can be volatile and/or non-volatile. Examples of non-volatile storage elements include magnetic hard discs, optical discs, floppy discs, flash memories, or forms of electrically programmable memories (EPROM) or electrically erasable and programmable (EEPROM) memories.

ISC 210 of machine 200 is configured to automatically switch between a first high idle speed and a second high idle speed for engine 202 based upon the load on the engine and the acceleration of the machine. For example, ISC 210 can be configured to: determine an actual load on engine 202 of machine 200; determine an actual acceleration of the machine; and automatically set the high idle speed of the engine based upon the engine load and the acceleration. In one example, ISC 210 compares the engine load to a load threshold and compares the acceleration to an acceleration threshold and, based thereon, automatically sets the high idle speed of engine 202.

In an example, ISC 210 determines the load on engine 202 by receiving data, or other information, for example, signals from an engine control module (ECM) indicative of the amount of power that is being drawn from the engine to propel machine 200 and execute other functions of the machine, for example, drive an implement like a bucket loader. Additionally, ISC 210 can receive data, signals or other information, for example, from the ECM, which is indicative of a total available amount of power from engine 202 at the current operational state thereof (e.g., speed and gear ratio). ISC 210 can compare the actual load on engine 202 to the total amount of power available from the engine.

ISC 210 can be in communication with a speed, acceleration, or other sensor associated with engine 202 or transmission 204, as examples. ISC 210 can periodically or continuously receive signals from the sensor based on which ISC 210 can determine the acceleration of machine 200. ISC 210 can compare the acceleration of machine 200 to an acceleration threshold, which may be, for example, a predetermined acceleration value stored in memory of ISC 210 or another device/system of machine 200.

In an example, ISC 210 automatically selects one of multiple high idle speeds of engine 202 based on the comparison of the actual engine load to available power and the comparison of acceleration to the associated acceleration threshold. The multiple high idle engine speeds can include, for example, a first high idle speed and a second high idle speed, which is greater than the first high idle speed. ISC 210 can compare the actual load on engine 202 to the total available engine power to determine if the actual load is equal to or greater than a threshold percentage of total available engine power. In the event ISC 210 determines that the actual load is below the threshold percentage of total available power, ISC 210 automatically selects the first high idle speed, as the current conditions do not warrant a higher power mode of operation of machine 200.

In the event ISC 210 determines that the actual load is equal to or greater than the threshold percentage of total available power, ISC 210 compares the acceleration of machine 200 to the threshold acceleration. In the event ISC 210 determines that acceleration is greater than or equal to the threshold acceleration, ISC 210 automatically selects the first high idle speed, because, although the engine load may warrant additional power availability, the relatively high rate of acceleration is indicative of a relatively minor benefit to machine performance from the additional power and a relatively high reduction of fuel economy. In the event ISC 210 determines that acceleration is less than than the threshold acceleration, ISC 210 automatically selects the second high idle speed for engine 202.

Figure 3:
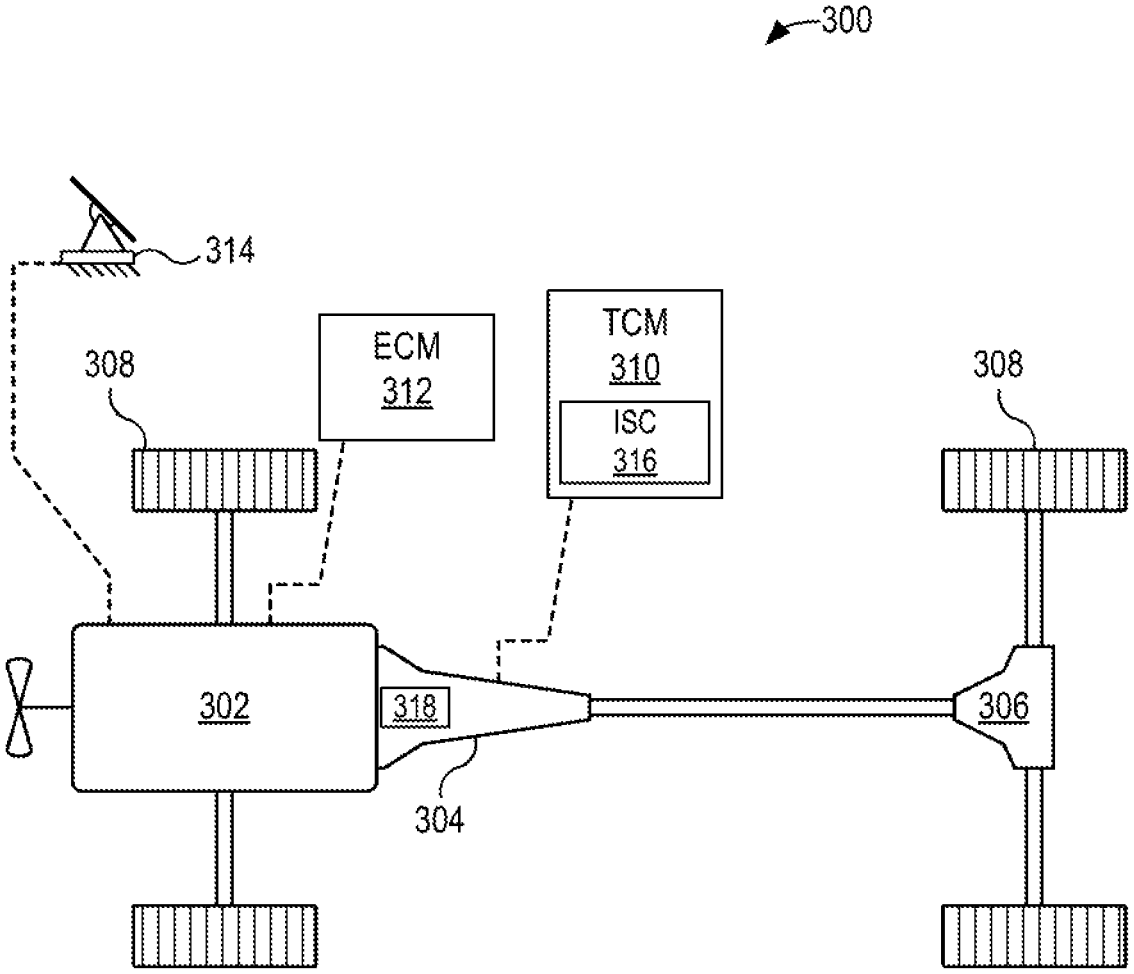
FIG. 3 depicts another example work machine in accordance with this disclosure.

FIG. 3 is a schematic depicting another example machine 300 in accordance with this disclosure. Machine 300 includes engine 302, transmission 304, differential 306, wheels 308, transmission control module (TCM) 310, engine control module (ECM) 312, and throttle control 314. In this example, TCM 310 includes ISC 316, which is configured to automatically select one of multiple high idle speeds of engine 302 based on various factors/parameters. ISC 316 can be similar in structure, function, componentry and other aspects as ISC 210 of the example of FIG. 210. ISC 316 can be implemented as a module, algorithm, circuit, or other sub-part of TCM 310. Additionally, ISC 316 can be a stand-alone control, which is communicatively connected to TCM 310. Moreover, in other examples in accordance with this disclosure, an ISC can be associated with, included in, and/or in communication with other controls of a work machine other than the TCM.

TCM 310 and ECM 312 can each be a type of electronic control unit (ECU). An electronic control unit (ECU) can be an embedded system that controls machine electrical systems and/or other subsystems of the machine. Types of ECUs include Electronic/engine Control Module, Powertrain Control Module, Transmission Control Module, Brake Control Module, Suspension Control Module, among other examples. In the case of industrial, construction, and other heavy machinery, example ECUs can also include an Implement Control Module associated with one or more implements coupled to and operable from the machine.

Example machine 300 includes TCM 310 and ECM 312. TCM 310 and ECM 312 can be communicatively connected and configured to send and receive data, sensor or other analog signals, and other information therebetween, as well as to/from other devices of the machine.

Each of TCM 310 and ECM 312 can include software, hardware, and combinations of hardware and software configured to execute a number of functions attributed to the components in the disclosed examples. The ECUs of machine 300 can be an analog, digital, or combination analog and digital controllers including a number of components. As examples, the ECUs of machine 300 can include integrated circuit boards or ICB(s), printed circuit boards PCB(s), processor(s), data storage devices, switches, relays, etcetera. Examples of processors can include any one or more of a microprocessor, a controller, a digital signal processor (DSP), an application specific integrated circuit (ASIC), a field-programmable gate array (FPGA), or equivalent discrete or integrated logic circuitry.

The ECUs of machine 300 may include storage media to store and/or retrieve data or other information, for example, signals from sensors. Examples of non-volatile storage devices include magnetic hard discs, optical discs, floppy discs, flash memories, or forms of electrically programmable memories (EPROM) or electrically erasable and programmable (EEPROM) memories. Examples of volatile storage devices include random access memories (RAM), dynamic random access memories (DRAM), static random access memories (SRAM), and other forms of volatile storage devices. The data storage devices can be used to store program instructions for execution by processor(s) of, for example, TCM 310 and ECM 312.

Engine 302 is operatively coupled to transmission 304, which can be a mechanical or hydraulic automatic transmission, as examples. Additionally, transmission 304 can be a continuously variable transmission (CVT), including, for example, a hydraulic CVT. Transmission 304 is operatively coupled to differential 306, which transmits power from the transmission to wheels 308 to propel machine 300. Engine power and speed can be controlled by an operator using throttle control 314. Throttle control 314 is depicted in the example of FIG. 3 as a foot peddle, but, in other examples, can be another type of input control device, including a hand lever or dial, as examples.

Transmission 304 includes speed sensor 318. Speed sensor 318 can be a variety of different types of sensors. In one example, speed sensor 318 includes a magnetic pickup sensor associated with a magnet embedded within a rotational component of transmission 304, including, for example, a gear tooth of the transmission.

Although not shown in FIG. 3, machine 300 can include one or more implements operatively coupled to the machine and configured to execute various functions, including excavation, grading, and compacting, as examples. Additionally, such implements may be driven by/draw power from (directly or indirectly) engine 302 and the actual load on the engine may therefore reflect loads produced by the implement(s).

ISC 316 of machine 300 is configured to automatically switch between a first high idle speed and a second high idle speed for engine 302 based upon the load on the engine and the acceleration of the machine. For example, ISC 316 can be configured to: determine an actual load on engine 302 of machine 300; determine an actual acceleration of the machine; and automatically set the high idle speed of the engine based upon the engine load and the acceleration. In one example, ISC 316 compares the engine load to a load threshold and compares the acceleration to an acceleration threshold and, based thereon, automatically sets the high idle speed of engine 302.

In an example, ISC 316 determines the load on engine 302 by receiving data, or other information, for example, signals from ECM 312 indicative of the amount of power that is being drawn from the engine to propel machine 300 and execute other functions of the machine, for example, drive an implement like a bucket loader. In an example, the actual load on engine 302 is indicated by the amount of torque generated by the engine at a given speed. The torque generated by engine 302 may correspond directly to an amount of fuel being consumed by the engine. In such cases, the torque being generated at the current speed can be calculated from a measurement of the current fueling rate of engine 302.

In an example, ECM 312 samples readings of fuel consumption rate from a fuel consumption or other sensor of engine 302. From the fuel consumption readings/measurements, ECM 312 can calculate the torque being generated by engine 302 and use this value as the actual engine load at the current speed of machine 300. Additionally, ECM 312 can determine the total available power available from engine 302 at the current speed (as well as, in some cases, other operational conditions). In an example, ECM 312 determines the actual load on engine 302 and the total available power for the engine and transmits this information/data to ISC 316 of TCM 310. In examples, ECM 312 determines actual engine load and total available power and send the same to ISC 316 periodically, including, for example, every 15-20 milliseconds.

ISC 316 can compare the actual load on engine 302 to the total amount of power available from the engine. In an example, ISC 316 determines what percentage of the total available power of engine 302 is being consumed by the actual engine load. For example, ISC 316 receives the actual engine load and the total available power of engine 302 at the current speed from ECM 312. ISC 316 divides the actual engine load by the total available power to determine the percentage of power use by engine 302. ISC 316 can then compare the percentage of total available power being used by engine 302 to a load threshold, which can be stored in memory of ISC 316 or TCM 310. In an example, the load threshold equals 90%. In another example, the load threshold equals 95%.

In an example, ISC 316 is in communication with speed sensor 318, either directly or via TCM 310. ISC 316 can periodically or continuously receive signals from speed sensor 318 based on which ISC 316 can determine the acceleration of machine 300. For example, ISC 316 can receive a plurality of signals from speed sensor 318, which the sensor samples at a plurality of different times. ISC 316 can be configured to calculate the acceleration of machine 300 based upon the multiple speeds of the machine at the multiple times. ISC 316 can compare the acceleration of machine 300 to an acceleration threshold, which may be, for example, a predetermined acceleration value stored in memory of ISC 316 or another device/system of machine 300 (for example, TCM 310 or ECM 312).

In an example, ISC 316 automatically selects one of multiple high idle speeds of engine 302 based on the comparison of the actual engine load to available power and the comparison of acceleration to the associated acceleration threshold. The multiple high idle engine speeds can include, for example, a first high idle speed and a second high idle speed, which is greater than the first high idle speed. ISC 316 can compare the actual load on engine 302 to the total available engine power to determine if the actual load is equal to or greater than a threshold percentage of total available engine power. In the event ISC 316 determines that the actual load is below the threshold percentage of total available power, ISC 316 automatically selects the first high idle speed, as the current conditions do not warrant a higher power mode of operation of machine 300.

In the event ISC 316 determines that the actual load is equal to or greater than the threshold percentage of total available power, ISC 316 compares the acceleration of machine 300 to the threshold acceleration. In the event ISC 316 determines that acceleration is greater than or equal to the threshold acceleration, ISC 316 automatically selects the first high idle speed, because, although the engine load may warrant additional power availability, the relatively high rate of acceleration is indicative of a relatively minor benefit to machine performance from the additional power and a relatively high reduction of fuel economy. In the event ISC 316 determines that acceleration is less than the threshold acceleration, ISC 316 automatically selects the second high idle speed for engine 302.

In an example, ISC 316 also implements a time delay as an additional factor for automatically setting/selecting the high idle speed of engine 302. The time delay can be used to add hysteresis to the idle speed control by requiring the actual engine load to be equal to or greater than the load threshold for a predetermined amount of time. In an example, ISC 316 is configured to determine a high engine load time. The high engine load time is an amount of time the actual load of engine 302 is equal to or greater than the load threshold. Additionally, ISC 316 can be configured to determine if the high engine load time is equal to or greater than a time threshold.

In an example, ISC 316 selects the engine high idle speed to the second high engine idle speed if: the actual engine load is equal to or greater than the load threshold; the high engine load time is equal to or greater than the time threshold AND the machine acceleration is less than the acceleration threshold. ISC 316 can, alternatively and additionally, select the first engine high idle speed if: the actual engine load is less than the load threshold; OR the high engine load time is less than the time threshold; OR the machine acceleration is less than the acceleration threshold.

In an example, ISC 316 can be configured to determine the actual engine load and determine if the actual load is equal to or greater than the load threshold. In the event ISC 316 determines that the actual engine load is equal to or greater than the threshold percentage of total available power, ISC 316 starts a high engine load timer and determines the actual engine load relative to total available throughout the duration of the timer, which is set to expire at the time threshold. If the actual engine load is equal to or greater than the threshold percentage of total available power for equal to or more than the threshold time, ISC 316 then determines the acceleration of machine 300, compares the acceleration to the acceleration threshold and sets the engine idle speed accordingly. If, however, the actual engine load drops below the threshold percentage of total available power before expiration of the high engine load timer, ISC 316 can be configured to reset and once again start monitoring for high engine loads.

Figure 4:
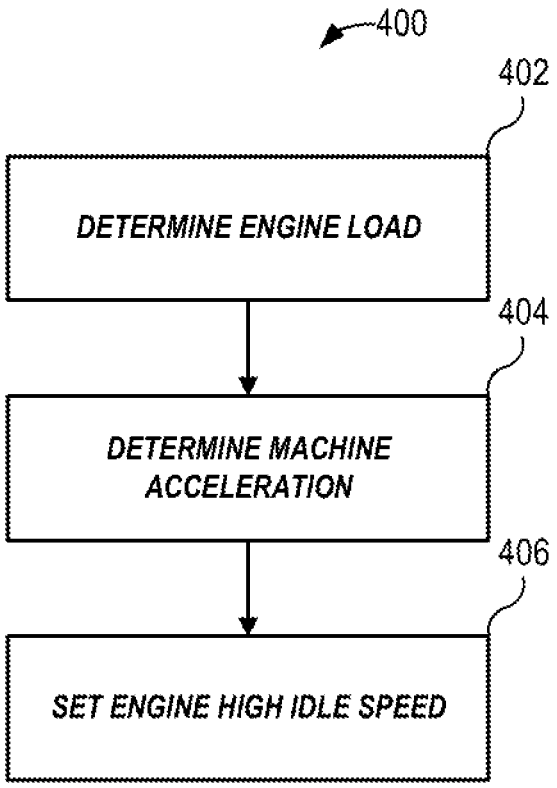
FIG. 4 is a flowchart depicting an example method of operating a work machine in accordance with this disclosure.

FIG. 4 is a flowchart depicting an example method of operating a work machine in accordance with this disclosure. In FIG. 4, method 400 includes determining a load on an engine of a work machine (402), determine an acceleration of the machine (404), and set the high idle speed of the engine of the machine based on the engine load and the machine acceleration (406). Examples and details of method 400 are set forth in the following section.

INDUSTRIAL APPLICABILITY

In an example in accordance with this disclosure, an operator operates a wheel loader (sometimes referred to as front end loader) work machine to process an area of material. With the engine running and the operator preparing to excavate some material from the designated area with foot off the throttle pedal and the machine in neutral, a controller of the work machine sets the idle speed of the engine to a predetermined low idle speed. In such an example, the controller may be configured to default to the low idle speed any time the machine is in an idle state/mode of operation, e.g. transmission in neutral and/or zero throttle. The operator is ready to begin and depresses the throttle foot peddle. The controller can be configured to modulate between low idle and an automatically selected first high idle speed depending on the percent of throttle depression. In addition to setting the engine to the first high idle speed after the throttle is engaged, the controller can be configured to execute a high idle speed control algorithm or itself may be or include an idle speed control.

The operator depresses the throttle to a maximum displacement of the throttle, for example, all the way to the floor of the cab. As the operator propels the machine to the designated work area, the machine traverses relatively level ground. The controller can be configured to monitor the load on the engine and the acceleration of the machine, as the operator moves the machine to the work area.

On the relatively level ground over which the machine is moving, the controller may, for example, determine that, as the operator has called for high output from the engine, the load on the engine is above the load threshold. For example, in such an instance, the controller may determine that the actual load on the engine at the current speed is above a threshold percentage of a total available engine power. The controller, having determined the actual load is greater than the load threshold, may also determine if the engine load stays above the load threshold for a threshold amount of time, which it does as the operator continues to move toward the work area with the throttle fully displaced. The controller may then determine the acceleration of the machine and compare the machine acceleration to an acceleration threshold.

As the operator has fully displaced the throttle to call maximum power from the engine, the machine acceleration may be relatively high and, in this example, is greater than the acceleration threshold. At this point, even though the actual load on the engine may be, for example, 95% of available engine power, which is above the 90% threshold, the performance gain in switching from the first (low) high idle speed to the second (high) high idle speed may only be marginal over the flat terrain, while the decrease in fuel economy may be significant. As such, the controller, having determined that machine acceleration has exceeded the acceleration threshold, sets or does not change the engine high idle speed to/from the first (low) high idle speed.

As the operator continues to move toward the work area, the machine begins to move onto and subsequently up an incline with the operator continuing to fully depress the throttle. The controller monitors the engine load relative to the load threshold and the machine acceleration relative to the acceleration threshold. As the machine moves up the incline, the load on the engine increases and the acceleration of the machine decreases. The controller, under such circumstances, may determine upon the incline that the engine load has crossed the load threshold, the load has stayed over the threshold for a threshold time, AND the acceleration of the machine has dropped below the acceleration threshold, at which point the controller sets the engine to the second (high) high idle speed.

In this example, the operator may be operating example work machine 100, 200, 300, or any other work machine in accordance with this disclosure. Additionally, the high idle speed control techniques set forth above and associated advantages and benefits may be employed in a variety of different types of work machines other than a wheel loader to improve fuel economy.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A work machine comprising:

an engine configured to generate power to operate the machine; and a controller configured to:

determine an actual load on the engine;

determine a machine acceleration; and select an engine high idle speed based upon the actual engine load and the machine acceleration.

2. The work machine of claim 1, wherein determining the machine acceleration comprises receiving one or more signals from a sensor, the one or more signals being indicative of the acceleration of the machine.

3. The work machine of claim 1, wherein determining the machine acceleration comprises:

receiving a plurality of speed signals from a speed sensor associated with the machine, the speed signals being indicative of the speed of the machine at a plurality of times; and calculating the machine acceleration based on the speed signals.

4. The work machine of claim 1, wherein the controller is configured to determine a high engine load duration, the high engine load duration being an amount of time the actual engine load is equal to or greater than a load threshold.

5. The work machine of claim 4, wherein the controller is configured to determine if the high engine load time is equal to or greater than a time threshold.

6. The work machine of claim 1, wherein the controller is configured to determine if the actual engine load is equal to or greater than a load threshold.

7. The work machine of claim 1, wherein the controller is configured to determine if the machine acceleration is less than an acceleration threshold.

8. wherein selecting the engine high idle speed comprises:

selecting the engine high idle speed to be a first engine high idle speed if either the actual engine load is less than a load threshold or the machine acceleration is equal to or greater than the acceleration threshold; and selecting the engine high idle speed to be a second engine high idle speed if the actual engine load is equal to or greater than a load threshold and the machine acceleration is less than the acceleration threshold, the first high engine idle speed being less than the second high engine idle speed.

9. The work machine of claim 8, wherein the controller is configured to determine a high engine load time, the high engine load time being an amount of time the actual engine load is equal to or greater than the load threshold.

10. The work machine of claim 9, wherein the controller is configured to determine if the high engine load time is equal to or greater than a time threshold.

11. The work machine of claim 10, wherein selecting the engine idle speed comprises:

selecting the engine high idle speed to be a second engine high idle speed if:

the actual engine load is equal to or greater than the load threshold;

the high engine load time is equal to or greater than the time threshold; and the machine acceleration is less than the acceleration threshold; and selecting the engine high idle speed to be a first engine high idle speed if:

the actual engine load is less than the load threshold; or the high engine load time is less than the time threshold; or the machine acceleration is less than the acceleration threshold, the first high engine idle speed being less than the second high engine idle speed.

12. The work machine of claim 6, wherein the controller determining if the actual engine load is equal to or greater than the load threshold comprises:

determining a total available power of the engine; and comparing the actual engine load to the total available engine power.

13. The work machine of claim 12, wherein comparing the actual engine load to the total available engine power comprises:

dividing the actual engine load by the total available engine power to determine percentage power consumption; and determining if the percentage power consumption is equal to or greater than the load threshold.

14. A method of operating a work machine, the method comprising:

determining, by a controller of the machine, an actual load on an engine of the machine;

determining, by the controller, an acceleration of the machine; and setting, by the controller, the idle speed of the engine based on the actual engine load and the machine acceleration.

15. The method of claim 14, wherein setting the engine high idle speed comprises:

setting the engine high idle speed to a first engine high idle speed if either the actual engine load is less than a load threshold or the machine acceleration is equal to or greater than an acceleration threshold; and setting the engine high idle speed to a second engine high idle speed if the actual engine load is equal to or greater than the load threshold and the machine acceleration is less than the acceleration threshold, the first engine high idle speed being less than the second engine high idle speed.

16. The work machine of claim 15, further comprising determining a high engine load duration, the high engine load duration being an amount of time the actual engine load is equal to or greater than the load threshold.

17. The work machine of claim 16, further comprising determining if the high engine load duration is equal to or greater than a time threshold.

18. The work machine of claim 17, wherein setting the engine high idle speed comprises:

setting the engine high idle speed to a second engine high idle speed if:

the actual engine load is equal to or greater than the load threshold;

the high engine load duration is equal to or greater than the time threshold; and the machine acceleration is less than the acceleration threshold; and setting the engine high idle speed to a first engine high idle speed if:

the actual engine load is less than the load threshold; or the high engine load duration is less than the time threshold; or the machine acceleration is less than the acceleration threshold, the first engine high idle speed being less than the second engine high idle speed.

19. The method of claim 15, further comprising determining if the actual engine load is equal to or greater than a load threshold.

20. The method of claim 19, wherein determining if the actual engine load is equal to or greater than a load threshold comprises:

determining a total available power of the engine;

dividing the actual engine load by the total available engine power to determine percentage power consumption; and determining if the percentage power consumption is equal to or greater than the load threshold.

* * * * *